US005588389A

United States Patent [19]

Carter, Jr.

[11] Patent Number: 5,588,389

[45] Date of Patent: Dec. 31, 1996

[54] DUAL LIFT BOAT HULL

[76] Inventor: Jay Carter, Jr., 1404 Chaparral, Burkburnett, Tex. 76354

[21] Appl. No.: 413,605

[22] Filed: Mar. 30, 1995

[51] Int. Cl.[6] ..... B63B 1/00

[52] U.S. Cl. ..... 114/271; 114/291

[58] Field of Search ..... 114/56, 63, 271, 114/291, 292; D12/311, 313

[56] References Cited

U.S. PATENT DOCUMENTS

| | | | |
|---|---|---|---|
| D. 49,358 | 7/1916 | LaChapelle | D12/313 |
| 5,191,853 | 3/1993 | Adler | 114/291 |

FOREIGN PATENT DOCUMENTS

| | | | |
|---|---|---|---|
| 506836 | 4/1920 | France | 114/291 |
| 10801 | 5/1913 | United Kingdom | 114/291 |
| 153065 | 10/1920 | United Kingdom | 114/291 |

*Primary Examiner*—Edwin L. Swinehart
*Attorney, Agent, or Firm*—Robert A. Felsman

[57] ABSTRACT

A boat hull having a bow lifting surface, a stepped bottom aft of the bow to create an air space between the water and the bottom of the hull and a stern lifting surface extending downwardly from the stepped bottom such that the bow lifting surface and the stern lifting surface angle of attack is fixed at the angle for maximum lift to drag for a given deadrise angle. The effect is to lift the hull vertically the maximum possible, so the wetted hull area and drag are reduced to the minimum. As the deadrise angle changes from 0 degrees to 25 degrees, the angle of attack for best lift to drag changes from approximately 7 degrees to 14 degrees. For a V-shaped hull the angle of attack is in a range of nine through fourteen degrees. A flat bottom hull should have an angle of attack in a range of six through eight degrees, preferably seven degrees.

9 Claims, 2 Drawing Sheets

DUAL LIFT BOAT HULL

BACKGROUND OF THE INVENTION

1. Field of the Invention

This invention relates in general to planing boat hulls and in particular to those having shapes to reduce drag.

2. Background Information

There is known in the prior art a single step hull design that has been used on some boats and on amphibian aircraft to reduce drag in part by increasing the planing angle over what it would have been without the step (see FIG. 5). This hull design has the effect of reducing the wetted area but is of limited effectiveness since the planing angle of attack cannot be held at its optimum to achieve lowest drag over a wide range of speeds. This single step hull design does have the advantage of providing two lifting surfaces, one at the bow and the other near the stern.

Boat hulls with two side by side planing surfaces, such as some catamarans are used to improve lateral stability rather than reduce drag. Most catamarans are sail powered and use a displacement hull rather than a planing hull. The hull design which is the subject of our invention is best suited for planing hulls with a length to width ratio greater than 4 and would be particularly well suited to a planing catamaran hull in which each planing surface generally has a very high length to width ratio.

SUMMARY OF THE INVENTION

It is the general object of my invention to provide a single hull having a stepped design with dual lifting surfaces operating at basically a constant angle of attack for best lift to drag.

The above object, as well as additional objects, features, and advantages of the invention are achieved with a boat having a three-stage hull: (1) a bow lifting surface, (2) a stepped bottom aft of the bow to create an air space between the water and the bottom of the hull and (3) a stern lifting surface extending downwardly from the stepped bottom such that the bow lifting surface and the stern lifting surface maximize lift by operating at its best lift to drag angle of attack over a wide range of speeds and reduce drag by lifting the hull and stepped bottom vertically to reduce the wetted hull surface area and enhance performance. The hull may be flat bottomed or V-shaped. In the flat bottom hull, the preferred angle of attack is in the range of six to eight degrees, preferably seven degrees. In the V-shaped hull, the selected angle of attack is in a range of from 9 through 14 degrees, depending upon the amount of deadrise angle employed. The amount of deadrise angle employed for any particular hull depends upon the water roughness for which the hull is basically designed. The deadrise angle may vary from 5 degrees with an angle of attack of approximately 8 degrees for very smooth, sheltered waters (swamps) to 25 degrees and an angle of attack of approximately 14 degrees for rough waters. Some ocean racing boats use deadrise angles greater than 25 degrees. The three-stage design of my hull, generally described above, achieves the best lift to drag ratio over a wide speed range.

Additional objects, features, and advantages of the invention will become apparent in the following detailed description.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
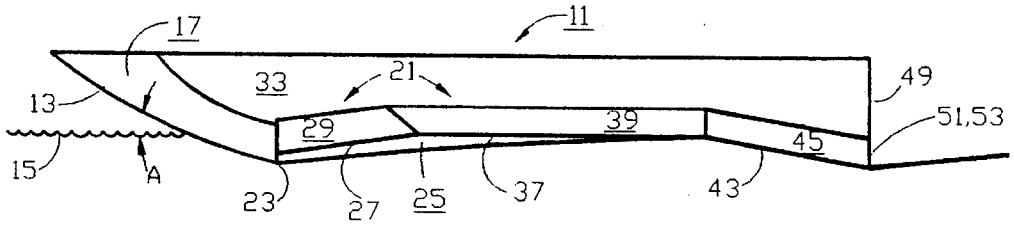
FIG. 1 is a schematic side elevational view of a boat with a V-shaped hull that includes the features of my invention, the boat moving forward at a planing speed.
Figure 2:
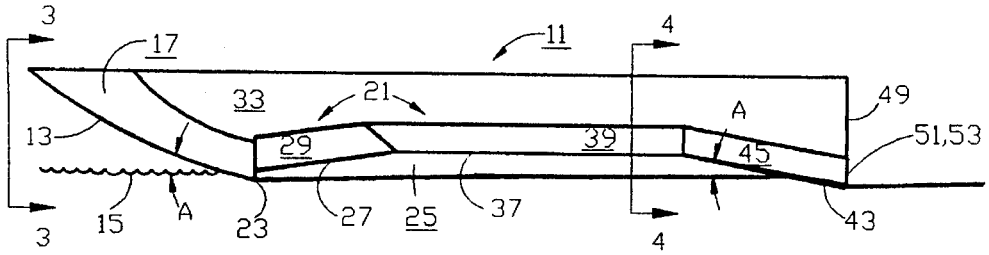
FIG. 2 is a schematic side elevational view of the boat hull of FIG. 1 when moving at a higher speed.
Figure 3:
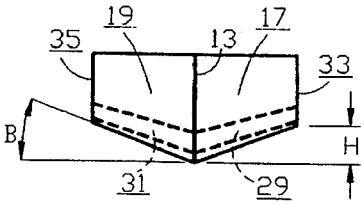
FIG. 3 is cross-sectional view as seen looking along the lines and arrows 3—3 of FIG. 2.

With reference now to the figures and in particular with reference to FIG. 1, the numeral 11 designates a boat having a first stage consisting of a bow lifting surface or surfaces defined by an edge 13 having an angle of attack A (see FIGS. 1 and 2) with reference to the water 15. In the preferred embodiment, the angle of attack A may vary from a range of about 9 to 14 degrees. The bow of the boat hull shown in FIG. 3 is V-shaped, and both the port lifting surface 19 and the starboard lifting surface 17 (see FIG. 3) have a deadrise angle B of attack in the range of about 20–25 degrees.

Each boat hull is designed in view of empirical data and experience that is known in the art. These angles of attack "A" for best lift to drag are based on experimental data and vary depending upon factors such as surface roughness, load vs. planing area and hull shape. For a general purpose sport "V" hull, this angle of attack "A" for best lift to drag could be in the range of 14 degrees for a 25 degree deadrise angle "B" near the front of edge 13 to a 12 degree angle of attack "A" for a 20 degree deadrise angle "B" near the edge 13 to a 10 degree angle of attack "A" for a 15 degree deadrise angle "B" at the stern lifting surfaces 45 and 47. For flat-bottomed boats with a deadrise angle B of 0 degrees, the angle of attack "A" for the best lift to drag is usually in a range of about six to eight degrees, usually about seven degrees.

Boat hull 11 has a second stage consisting of a stepped bottom 21 located aft of the bow lifting surfaces 17 and 19 beginning at a transverse edge 23 to create an air space 25 between the water 15 and the bottom of the hull.

The stepped bottom 21 of the hull has an inclined forward region defined by an edge 27 that extends upwardly from the transverse edge 23 of bow lifting edge 13 and bow lifting surfaces 17 and 19. The edge 27 is the intersection of a port surface 29 and a starboard surface 31 (see FIG. 3). These oblique surfaces 29 and 31 intersect the port and starboard sides 33 and 35 of the hull.

Figure 4:
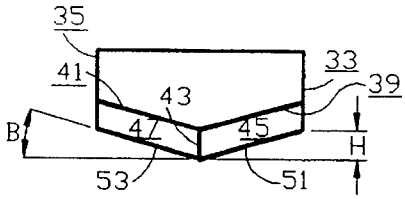
FIG. 4 is a frontal view as seen looking along the lines and arrows 4—4 of FIG. 2.

A rearward region of the stepped bottom 21 of the hull has a generally horizontal edge 37 that intersects the inclined edge 27 of the forward region. The edge 37 is defined by port and starboard oblique surfaces 39 and 41 (see FIG. 4) that intersect the port and starboard sides 33 and 35 of the hull.

The hull has a third stage consisting of a stern lifting surface or surfaces defined by a downwardly inclined rearward region of the stepped bottom 21. This stage has a downwardly inclined edge 43, as well as port and starboard oblique surfaces 45 and 47 (see FIG. 4). This region of the hull intersects the stern 49 to define intersection port and starboard edges 51 and 53 (see FIG. 4).

The size of the air space 25 depends upon the forward speed of the hull, indicated in FIG. 1 by the flow of the water to be relatively slow. The size of the air space 25 at a higher speed is shown in FIG. 2. The size of the air space 25 varies with the range of cruising speeds from low to high.

For the V-bottom hull shown in FIGS. 1–4, the bottom of the hull at each stage may have a varying deadrise angle B and a deadrise height H. For the preferred embodiment of FIGS. 1–4, the preferred angle B varies from 25 degrees at the front of the bow lifting surface to 20 degrees at the rear of the bow lifting surface to 15 degrees at the stern lifting surface.

As shown in FIG. 1, at relatively low forward speeds an air space 25 is beginning to be created and reaches the relatively large size shown in FIG. 2 at higher velocities. At the high velocities, the dual bow lifting surfaces 17, 19 and the dual lifting surfaces 45, 47 of the stern when set at their best lift to drag angle generate the greatest lift to create the largest air space 25 shown in FIG. 2, thus reducing the wetted area of the hull and corresponding drag the greatest amount possible over a wide range of speeds.

Figure 5:
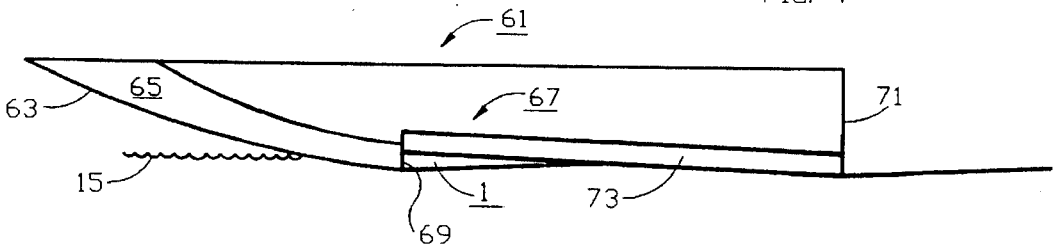
FIGURE 5 (PRIOR ART)
FIG. 5 is a schematic side elevational view of a prior art stepped hull design.
Figure 6:
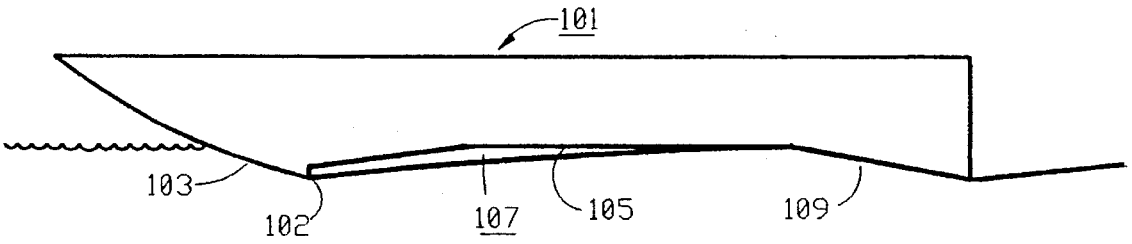
FIG. 6 is a schematic side elevational view of a flat bottom boat moving at a planing speed.
Figure 7:
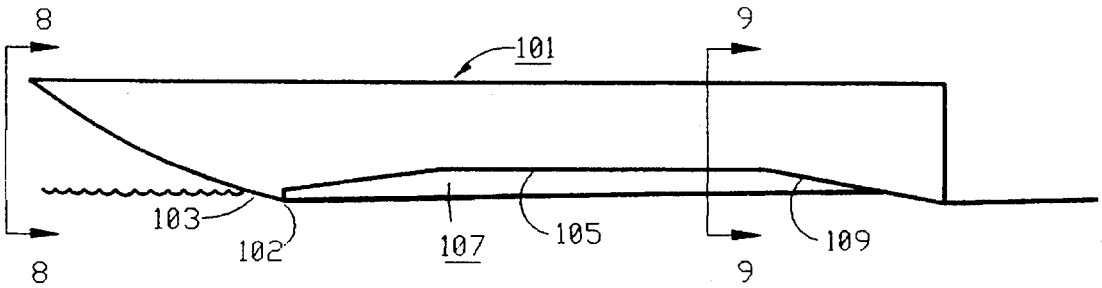
FIG. 7 is a schematic side elevational view of the boat of FIG. 6 moving at a slow speed.
Figure 8:
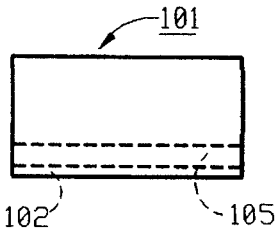
FIG. 8 is a frontal view as seen looking along the lines and arrows 8—8 of FIG. 7.
Figure 9:
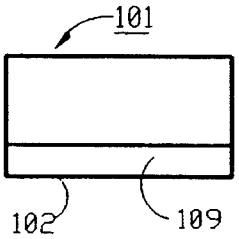
FIG. 9 is a cross-sectional view as seen looking along the lines and arrows 9—9 of FIG. 7.

A single stepped hull design 61, shown in FIG. 5, has been used on some boats and amphibian aircraft. This design has a bow edge 63 defined by a port lifting surface 65 and a starboard lifting surface (not shown). The stepped bottom 67 begins at the transverse edge 69 and is inclined downwardly toward the stern 71, containing a port lifting surface 73 and a starboard lifting surface (not shown). This design reduces drag in part by increasing the planing angle over what it would have been without the step to reduce the wetted area of the hull. However, it is not as efficient as the hull design of FIGS. 1 through 4, where the planing angle of attack A can be held constant at its optimum to achieve lower drag over a wide range of speeds.

It should be apparent from the foregoing description that the invention has significant advantages. The goal of any hull design is to keep the drag as low as possible within given ride and handling characteristics. To accomplish this goal, it is necessary to understand what causes a boat to lift up out of the water and produce drag. Drag can be broken down into two parts: 1) Profile drag (PD) is defined by the equation PD=K*V**2*WA, where K is a drag coefficient based on the wetted area surface finish and its angle of attack, V is the boat speed, WA is the wetted area exposed to the water flow; 2) Induced drag (ID) is defined by the equation ID=WT**2/PA*AR*V*M, where WT is the boat weight, PA is the boat planing area, AR is the aspect ratio (width to length of planing surface) and M which is a shape efficiency factor based on factors such as AR and hull deadrise or "V" angle. The lift (L) of the hull is defined by the equation L=C*V**2*PA*A, where C is a constant and A is the angle of the water flow relative to the planing surface - within certain limits.

One cannot do anything about the boat gross weight except make the boat as structurally efficient as possible or the boat width if it is to be trailer able or the deadrise if the boat is to have a soft ride in rough water, but if the angle A can be held constant and at its optimum for best lift to drag, the wetted area and resulting drag can be reduced significantly at increased boat speeds. The angle A for best lift to drag in a V-bottom boat will in most cases be between 9 and 14 degrees depending upon the amount of deadrise angle and the aspect ratio (AR). The deadrise angle might vary from 0 to 5 degrees (flat bottom for smooth water) to 25 degrees (deep V for a smoother ride in rough water).

An example of how holding the angle A at its optimum over increasing boat speeds reduces drag follows: From the equation for lift, double the boat velocity, and assume C and A remain constant and the planing area (PA) will be reduced by a factor of 4 with the profile drag (PD) also being reduced by a factor of 4, assuming the wetted area is the same as the planing area. The profile drag will then stay constant even though the velocity is doubled (a significant achievement). The induced drag (ID) does increase by a factor of 2 as shown from the equation for induced drag, since the boat velocity is doubled and the planing area is reduced by ¼, but at higher boat speeds the induced drag can be much less than the profile drag, so changes to the induced drag will have little effect on the boat overall drag.

The above-described hull design has two lifting/planing surfaces at the bow and at the stern as shown and described. The planing surfaces are separated by as much distance as practical so the hull pitch will stay nearly constant regardless of speed. In this way the planing surface angle A relative to the water flow can be held at the optimum over a wide range of speeds for its best lift to drag. As the speed increases, the hull 11 lifts out of the water 15 reducing its wetted area. Ideally there should never be any more surface contacting the water than needed to support the boat for a given speed.

The bow planing surface creates a wave which the stern planing surface rides upon. The angle of the stern planning surface will be different than the bow angle relative to horizontal because of the water flow angle formed by the bow wave, although the angle A of both planing surfaces relative to the water flow should be the same if the deadrise angle is the same.

On conventional hulls the planing surface flattens out as speed increases so the hull will be at its best lift to drag angle A for a only one speed at a given boat weight. At all other speeds the angle of the planing surface will not be at its optimum for lowest drag. A long boat relative to its width will have an even flatter planing angle with an increased wetted area, therefore the dual lift hull has the greatest drag reduction potential on boats with long narrow hulls.

An alternate embodiment is shown in FIGS. 6–9, which illustrates a boat hull 101 having a flat bottom 102 bow lifting surface 103, with a first angle of attack selected to minimize lift to drag. A stepped bottom 105 aft of the bow creates an air space above the water 107 at cruising speeds. A stem lifting surface 109 extends downwardly from the stepped bottom 105, having a selected angle of attack in a range of about six to eight degrees, preferably about seven degrees, the same as that of the first angle of attack.

Although the invention has been described with reference to specific embodiments, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

What is claimed is:

1. A dual lift boat hull comprising;

a bow lifting surface having a first angle of attack selected to maximize lift to drag;

a stepped bottom aft of the bow lifting surface to create an air space between the water and the bottom of the hull at cruising speeds;

a stern lifting surface extending downwardly from the stepped bottom and having a second selected angle of attack relative to the water flow to maximize lift to drag;

wherein the hull is flat bottomed and said first and said second selected angles of attack are in a range of about six to eight degrees; and whereby the bow lifting surface and the stern lifting surface maximize lift and reduce drag by lifting the hull and stepped bottom vertically to reduce the wetted hull surface area and enhance performance.

2. The invention defined by claim 1 wherein said first and said second angles of attack are about seven degrees.

3. The invention defined by claim 1 wherein the boat hull comprises:

an inclined first stage extending downwardly from the bow to an edge defining the termination of the bow lifting surface and upwardly into intersection with;

a generally horizontal second stage; and an inclined third stage extending downwardly from the generally horizontal stage to the stern of the hull.

4. The invention defined by claim 1 wherein said first angle of attack is in a range of about six through eight degrees.

5. The invention defined by claim 4 wherein said angles of attack are substantially equal.

6. The invention defined by claim 5 wherein said angles of attack are about seven degrees.

7. A dual lift boat hull comprising:

a V-shaped bow with a selected first deadrise angle, including port and starboard lifting surfaces, each with a selected first attack angle to maximize lift to drag for the given deadrise angle;

a stepped bottom aft of the V-shaped bow to create an air space between the water and the bottom of the hull at cruising speeds;

a V-shaped stern with a selected second deadrise angle and including port and starboard lifting surfaces extending downwardly from the stepped bottom, each of said lifting surfaces having a second angle of attack selected to maximize lift to drag for the given deadrise angle;

wherein the deadrise angle is selected from a range of about 10 to 25 degrees;

wherein said first and said second angles of attack are selected from the range of about 9 through 14 degrees; and whereby the bow lifting surfaces and the stern lifting surfaces tend to maximize lift and reduce drag by lifting the hull partially from the water to reduce the wetted hull surface area.

8. The invention defined by claim 7 wherein said first angle of attack is in a range of about nine through fourteen degrees.

9. The invention defined by claim 8 wherein said angles of attack are substantially equal.

* * * * *